United States Patent [19]

Plahm

[11] 4,418,513

[45] Dec. 6, 1983

[54] PACKAGING MACHINE WITH MEANS FOR CLOSING FLEXIBLE POUCHES AROUND A NOZZLE

[75] Inventor: Jack E. Plahm, Bradenton, Fla.

[73] Assignee: Rexham Corporation, New York, N.Y.

[21] Appl. No.: 254,916

[22] Filed: Apr. 16, 1981

[51] Int. Cl.[3] ..... B65B 31/00

[52] U.S. Cl. ..... 53/434; 53/481; 53/512; 53/371

[58] Field of Search ..... 53/479–481, 53/292, 387, 512, 371, 373, 434

[56] References Cited

U.S. PATENT DOCUMENTS

| | | | |
|---|---|---|---|
| 2,423,237 | 7/1947 | Haslacher | 53/479 X |
| 3,182,432 | 5/1965 | Canfield | 53/112 |
| 3,430,414 | 3/1969 | Ludwig et al. | 53/79 |
| 3,619,975 | 11/1971 | Johnson et al. | 53/112 B |
| 3,914,917 | 10/1975 | Young | 53/479 X |
| 4,081,942 | 4/1973 | Johnson | 53/22 B |
| 4,170,347 | 10/1979 | Lewis | 493/450 X |

*Primary Examiner*—A. J. Heinz

*Attorney, Agent, or Firm*—Leydig, Voit, Osann, Mayer & Holt, Ltd.

[57] ABSTRACT

Flexible pouches filled with product are advanced to a steaming station where steam from a steam nozzle is directed downwardly toward the pouches to drive air therefrom. A vacuum nozzle is inserted downwardly within the steam nozzle and into each pouch at the steaming station, the upper end portion of the pouch is closed around the vacuum nozzle and then a vacuum is drawn through the vacuum nozzle to evacuate the air in the pouch. The top of the pouch is sealed immediately after the vacuum nozzle is retracted out of the pouch. To close the pouch around the vacuum nozzle, two heads are disposed on opposite sides of the pouch but are located out of contact with the pouch. Jets of pressurized air are directed from the heads and against the pouch to close the pouch against the vacuum nozzle without creating wrinkles in the pouch.

8 Claims, 7 Drawing Figures

PACKAGING MACHINE WITH MEANS FOR CLOSING FLEXIBLE POUCHES AROUND A NOZZLE

BACKGROUND OF THE INVENTION

This invention relates to a packaging machine and to a method of filling flexible pouches with product, purging air from the filled pouches, and then sealing the pouches.

In the packaging of certain products, and particularly food products, the filled and sealed pouches are delivered to an autoclave or retort and are heated to high temperatures so as to sterilize the product in the pouches. In order for this packaging process to be successful, it is important that the sealed pouch be substantially free of air when the pouch is delivered to the autoclave. If any significant amount of air is present in the pouch, the air will expand when subjected to the high temperatures in the autoclave and will cause the pouch to balloon, such ballooning sometimes destroying the seals of the pouch. Even if the pouch is not subjected to autoclaving, it is often desirable to remove the air from the pouch so that the product will be packaged in an oxygen-free environment and will possess a long stable shelf life.

One method of removing air from pouches is disclosed in Johnson United States application Ser. No. 247,253, filed Mar. 25, 1981 and entitled Machine And Method For Making Substantially Air-Free Sealed Pouches. In the system disclosed in the Johnson application, filled pouches are advanced beneath a steam nozzle and are subjected to a downward flow of steam which tends to drive air from the pouches. While each pouch is beneath the steam nozzle, a vacuum nozzle is inserted downwardly into the pouch and then the upper end portion of the pouch is closed around the vacuum nozzle to temporarily seal the pouch to the nozzle. A vacuum then is drawn through the vacuum nozzle to evacuate air from the pouch. While the pouch is still closed around the vacuum nozzle, the latter is retracted from the pouch and then the upper end portion of the pouch is closed and is heat-sealed. All of the foregoing operations preferably take place while steam is being directed downwardly toward the pouch. The steam tends to purge the pouch of air before the vacuum nozzle is inserted into the pouch, facilitates the drawing of a vacuum in the pouch by the vacuum nozzle, and prevents air from entering the pouch as the vacuum nozzle is retracted out of the pouch.

While the steam is beneficial from the standpoint of helping to reduce the air content of the pouches, the steam makes it difficult to form wrinkle-free top heat seals along the upper end portions of the pouch. The steam tends to soften and wilt the upper end portions of the pouches and thus makes the pouches susceptible to wrinkling. In the Johnson system, the upper end portions of the pouches tend to particularly wrinkle when the pouches are closed around the vacuum nozzle.

SUMMARY OF THE INVENTION

The general aim of the present invention is to provide new and improved means which more effectively seal the pouch around the vacuum nozzle and which, at the same time, enable a substantially wrinkle-free top heat seal to be formed along the upper end portion of the pouch.

A more detailed object of the invention is to seal the pouch around the vacuum nozzle with pressurized air jets directed from unique heads located on opposite sides of the pouch. The air jets cause the pouch to conform intimately to the nozzle to establish a good seal and yet the heads themselves do not physically contact the pouch and form wrinkles therein.

The invention also resides in the novel construction of the closing heads and in the unique manner of stopping the heads close to but out of contact with the sides of the pouch.

These and other objects and advantages of the invention will become more apparent from the following detailed description when taken in conjunction with the accompanying drawings.

DETAILED DESCRIPTION OF THE PREFERRED EMBODIMENT

Figure 1:
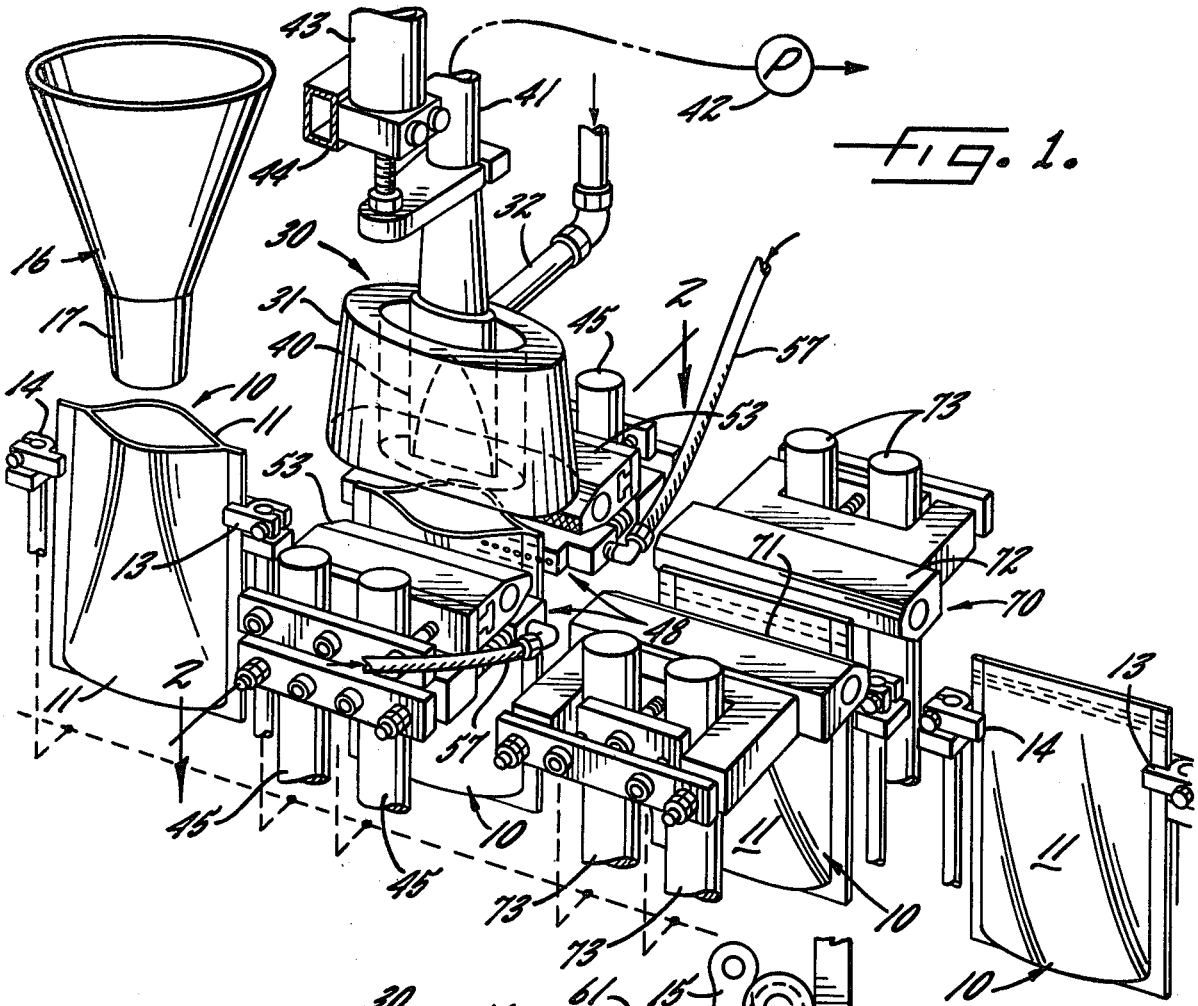
FIG. 1 is a fragmentary perspective view of a packaging machine having new and improved closing heads incorporating the unique features of the present invention.

As shown in the drawings for purposes of illustration, the invention is embodied in a packaging machine for filling and sealing envelope-type pouches 10. Such a pouch usually is made from a single or composite sheet of flexible material having at least one side which is heat sealable. The pouch includes two flexible panels 11 which are sealed or otherwise joined together along their side and bottom margins, the upper end of the pouch being open until the pouch is filled and sealed.

Figure 2:
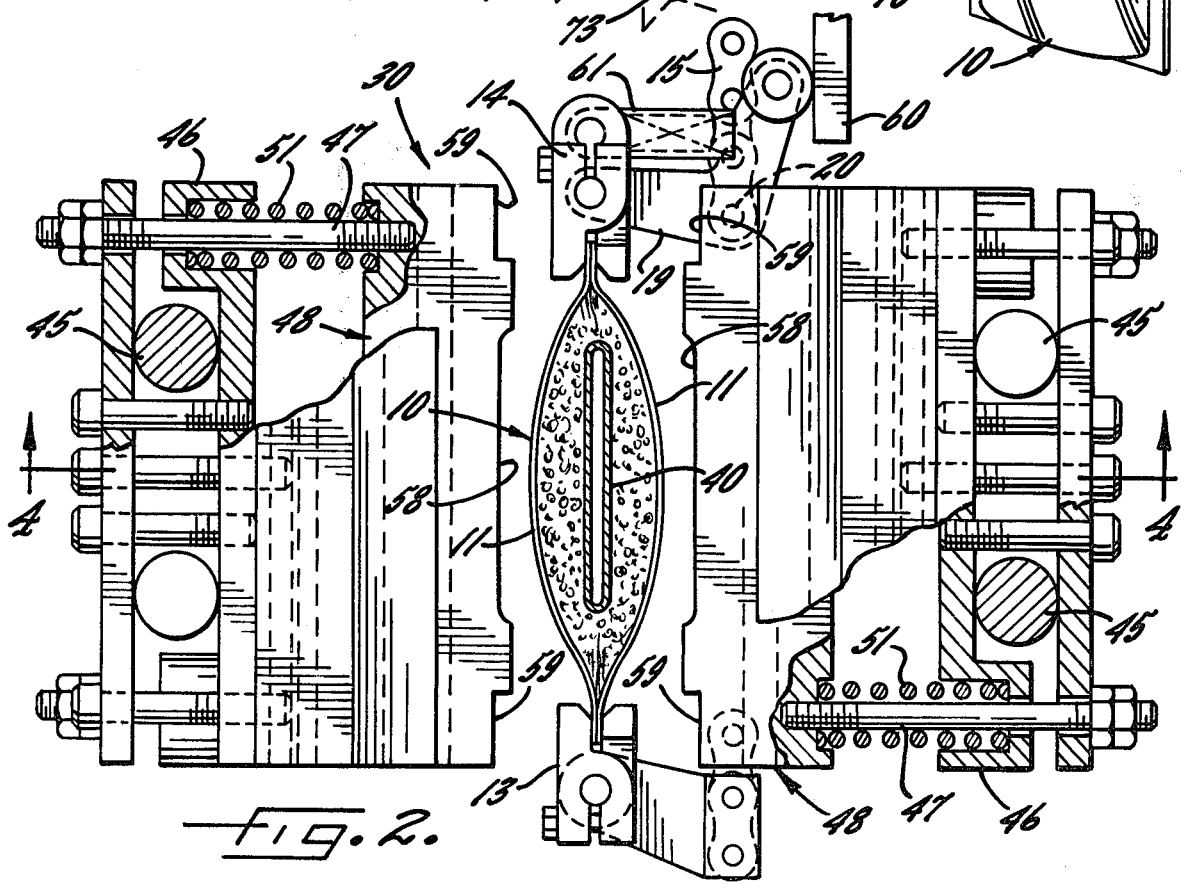
FIG. 2 is an enlarged cross-section taken substantially along the line 2—2 of FIG. 1 and showing certain parts of the machine.

In many respects, the packaging machine is similar to that disclosed in Johnson et al U.S. Pat. No. 3,553,934 and thus certain elements of the machine need not be described in detail. It will suffice to say that each pouch 10 is adapted to be gripped releasably at its side margins by leading and trailing clamps 13 and 14 which are carried on a chain 15 (FIG. 2). The latter is adapted to be advanced intermittently by a drive mechanism (not shown) and, as the chain is advanced along a predetermined path, the pouches are moved into and momentarily dwell at a series of horizontally spaced stations where packaging operations are performed on the pouches. The pouches herein are advanced in spaced edgewise relation and are held with their open ends facing upwardly. In the present instance, the pouches are relatively large and having a capacity of, for example, from one to three liters.

Herein, the machine includes a filling station 16 (FIG. 1) having a dispenser spout 17 for depositing a product into each pouch 10 as the latter dwells beneath the spout. In one particular packaging operation, the product which is discharged through the spout is a particulate solid product such as peas which may be cold or slightly warm. To facilitate dispensing of the product into the pouch, the trailing clamp 14 is adapted to be shifted toward the leading clamp 13 and, when the trailing clamp is so shifted, it causes the panels 11 of the pouch to bow outwardly and open the upper end portion or mouth of the pouch as shown in FIGS. 1 and 2. In order to effect shifting of the trailing clamp 14, the latter is carried on a bellcrank 19 (FIG. 2) which is pivotally mounted at 20 on the chain 15. When the trailing clamp is located in the filling station 16, a stationary cam (not shown) engages a roller 21 on one arm of the bellcrank 19 and causes the latter to swing counterclockwise about the pivot 20 and thereby shift the trailing clamp toward the leading clamp 13 and effect opening of the pouch. For a more detailed disclosure of a shiftable bag clamp, reference may be had to Lense et al U.S. Pat. No. 3,568,402.

Figure 4:
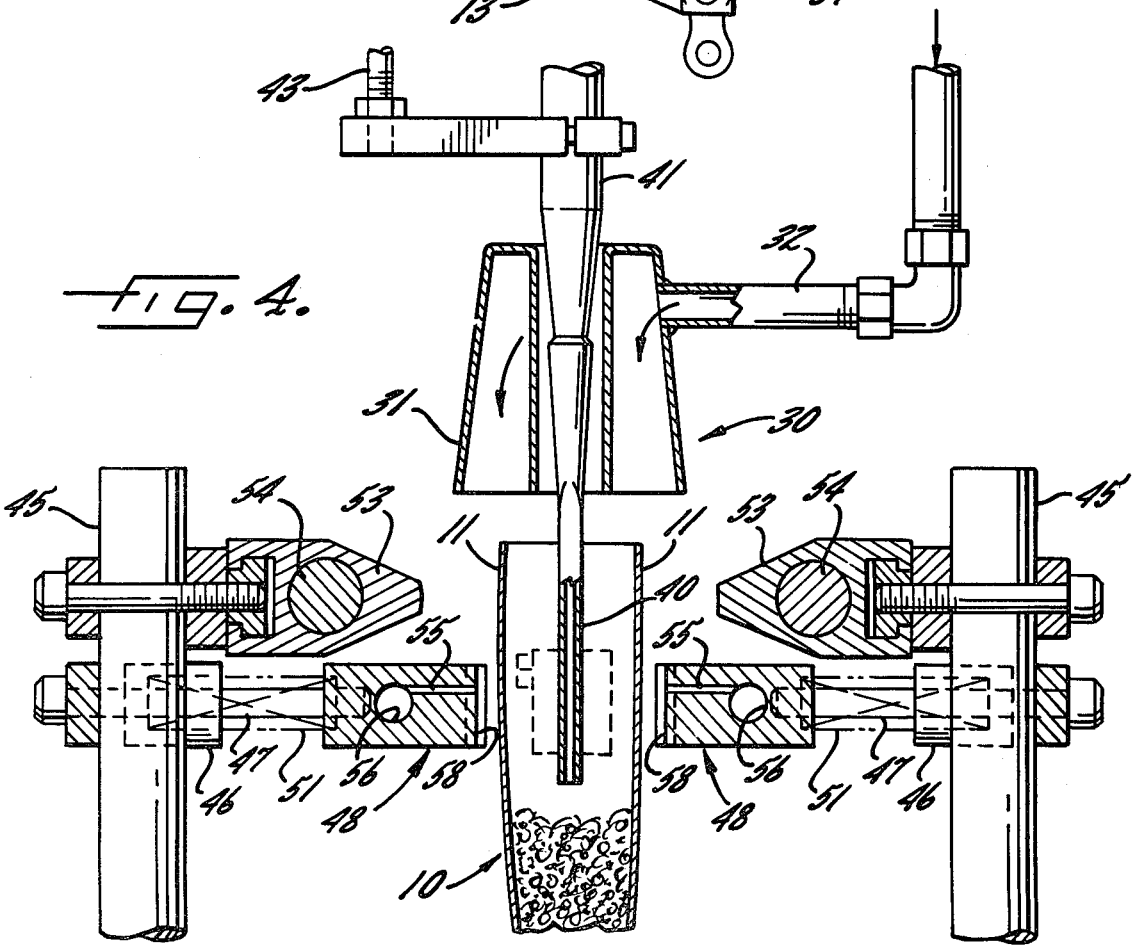
FIG. 4 is a fragmentary cross-section taken substantially along the line 4—4 of FIG. 2 and shows the vacuum nozzle inserted into the pouch.

After being filled, each pouch 10 advances to and dwells in a steaming station 30 where dry steam at a temperature of approximately 375 degrees F. and at a pressure of about 3 p.s.i. is introduced into the pouch through a nozzle 31 (FIGS. 1 and 4) when the pouch first dwells and while the upper end of the pouch is still held open by the trailing clamp 14. The steam drives air and gases out of the pouch for a purpose to be explained subsequently. As shown in FIGS. 1 and 4, the steam nozzle 31 is located just above the upper end of each pouch which dwells in the steaming station 30 and is of an elongated shape so as to discharge the steam across substantially the entire length of the mouth of the pouch. Steam is admitted continuously into the nozzle through a pipe 32.

After each pouch 10 is flushed with steam and is purged of air, its upper end portion is heat sealed and the pouch is advanced to a station 33 (FIG. 1) for removal from the clamps 13 and 14. The pouch is subsequently transferred to an autoclave (not shown) which is adapted to heat the pouch to a high temperature in order to sterilize the contents of the pouch. Any air which is in the pouch will expand when subjected to the heat of the autoclave and, if any significant amount of air is present in the pouch, it will cause the pouch to balloon excessively and may cause either the panels 11 or the seals to break. Also, the presence of oxygen in the pouch is detrimental to the shelf life of some products. Accordingly, it is important to remove air from the pouch and, in the present instance, this is partially achieved by introducing steam into the pouch at the steaming station 30. The steam drives some of the air out of the pouch and, upon condensing, creates a vacuum in the pouch.

Additional air is removed from the pouch 10 by mechanically creating a vacuum in the pouch with a vacuum nozzle 40 while steam is being directed downwardly toward the pouch from the steam nozzle 31. When the pouch dwells in the steaming station 30, the vacuum nozzle 40 is inserted downwardly into the pouch, the upper end portion of the pouch is closed around the vacuum nozzle, and a vacuum is drawn through the vacuum nozzle to evacuate air from the pouch. Thereafter, the vacuum nozzle is retracted out of the pouch while the upper end portion of the pouch is still closed around the vacuum nozzle and, immediately after the vacuum nozzle has been retracted, the upper end portion of the pouch is closed and preferably is sealed. All of the foregoing steps are carried out while the pouch is subjected to a continuous downward flow of steam from the steam nozzle 31. Purging of the pouch by using a combination of steam and mechanical vacuum results in more effective and more consistent removal of air than is the case when either is used alone and particularly when the pouches are advanced at a high rate.

The vacuum nozzle 40 preferably is disposed within the steam nozzle 31 and is adapted to move upwardly and downwardly therein. The vacuum nozzle is substantially flat in shape and its upper end is connected to a pipe 41 (FIG. 1) which, in turn, is connected to a vacuum pump 42 by a flexible line. To extend and retract the vacuum nozzle, a reciprocating pneumatic actuator 43 is connected between the pipe 41 and a fixed frame member 44. The actuator is operated in timed relation with the advance of the pouches 10 and is effective to shift the vacuum nozzle downwardly just after each pouch dwells in the steaming station 30 and to retract the vacuum nozzle upwardly out of the pouch before the pouch is advanced out of the steaming station.

In order to effect closing of the pouch 10, two upright rods 45 are located on each side of the pouch and are adapted to be moved toward and away from the pouch by conventional mechanism (not shown). Spanning each pair of rods is a mounting bar 46 (FIGS. 2 and 4) which slidably receives two bolts 47. Attached to the inboard ends of each pair of bolts is a head 48 which is adapted to close the upper end portion of the pouch 10 around the vacuum nozzle 40. Coil springs 51 are telescoped over the bolts 47 and are compressed between the bars 46 and the heads 48 to urge the heads inwardly to the pouch.

Preferably carried on the rods 45 and located above the closing heads 48 are two opposing heat sealing bars 53 (FIG. 4) which are equipped with heating elements 54. When the rods 45 are retracted outwardly, the sealing bars 53 are located outwardly of the closing shoes 48 as shown in FIG. 4 and, when the rods are shifted fully inwardly, the sealing bars engage the upper end portions of the side panels 11 of the pouch 10 to form a heat seal along the top of the pouch (see FIG. 7).

In accordance with the present invention, the closing heads 48 are uniquely constructed to close the pouch 10 tightly and uniformly around the vacuum nozzle 40 without the heads physically contacting the pouch. As a result, a good seal is established between the pouch 10 and the nozzle 40 to enable a vacuum to be effectively drawn in the pouch and yet, at the same time, the pouch is not wrinkled by the closing heads 48 since the heads do not touch the pouch. Accordingly, a substantially wrinkle-free top seal can be formed along the upper end portion of the pouch after the nozzle 40 has been retracted from the pouch.

More specifically, each closing head 48 is in the form of an elongated manifold having a length greater than the width of the pouch 10. In carrying out the invention, several narrow passages 55 (FIGS. 3 and 4) are formed though each head and are spaced along the length thereof. Each passage extends from the inner side of the head to an elongated bore 56 formed in the head at about the center thereof. A flexible line 57 is connected to one end of each bore and leads to a source of pressurized air. When the line 57 and the bore 56 are pressurized, air jets are directed through the passages 55 and against the sides of the pouch 10.

To accommodate the vacuum nozzle 40, a recess or notch 58 (FIG. 3) is formed in the inner side of each head. Each notch is complementary in size and shape to the size and shape of the nozzle. The notch enables those passages 55 adjacent the ends of the notch to be positioned closely adjacent the side edge portions of the pouch 10 and enables those passages which are within the notch to be disposed closely adjacent the center nozzle-receiving portion of the pouch (see FIG. 3). The end portions of each head also are notched as indicated at 59 where the head is disposed in opposing relation with the bag clamps 13 and 14.

With the foregoing arrangement, each pouch 10 is advanced into the steaming station 30 while the closing heads 48 and the sealing bars 53 are retracted away from the pouch and are held in inactive positions as shown in FIGS. 2 and 4 and while the pouch is held in a widely open position by the bag clamps 13 and 14. As the pouch dwells and as steam is introduced into the pouch from the steam nozzle 31, the vacuum nozzle 40 is inserted downwardly within the steam nozzle and into the pouch 10 (see FIG. 4). Thereafter, the upper end portion of the pouch is closed by shifting the trailing bag clamp 14 away from the leading clamp 13 so as to draw the panels 11 of the pouch toward one another. To this end, a swingable bar 60 (FIG. 2) is located adjacent the upstream end of the steaming station 30. When each pouch first enters the station, the bar is positioned as shown in FIG. 2 and engages the roller 21 of the trailing bag clamp 14 to keep that clamp shifted toward the leading clamp 13 and thus hold the pouch open. After the pouch has stopped in the steaming station for a short interval and has received the vacuum nozzle 40, the bar 35 is swung counterclockwise to the position shown in FIG. 3. As an incident to such swinging, a coil spring 61 forces the bellcrank 19 to turn clockwise about the pivot 20, the spring being compressed between the bellcrank and the trailing clamp 14. Clockwise turning of the bellcrank shifts the trailing clamp away from the leading clamp 13 to draw the panels of the pouch toward one another.

Figure 3:
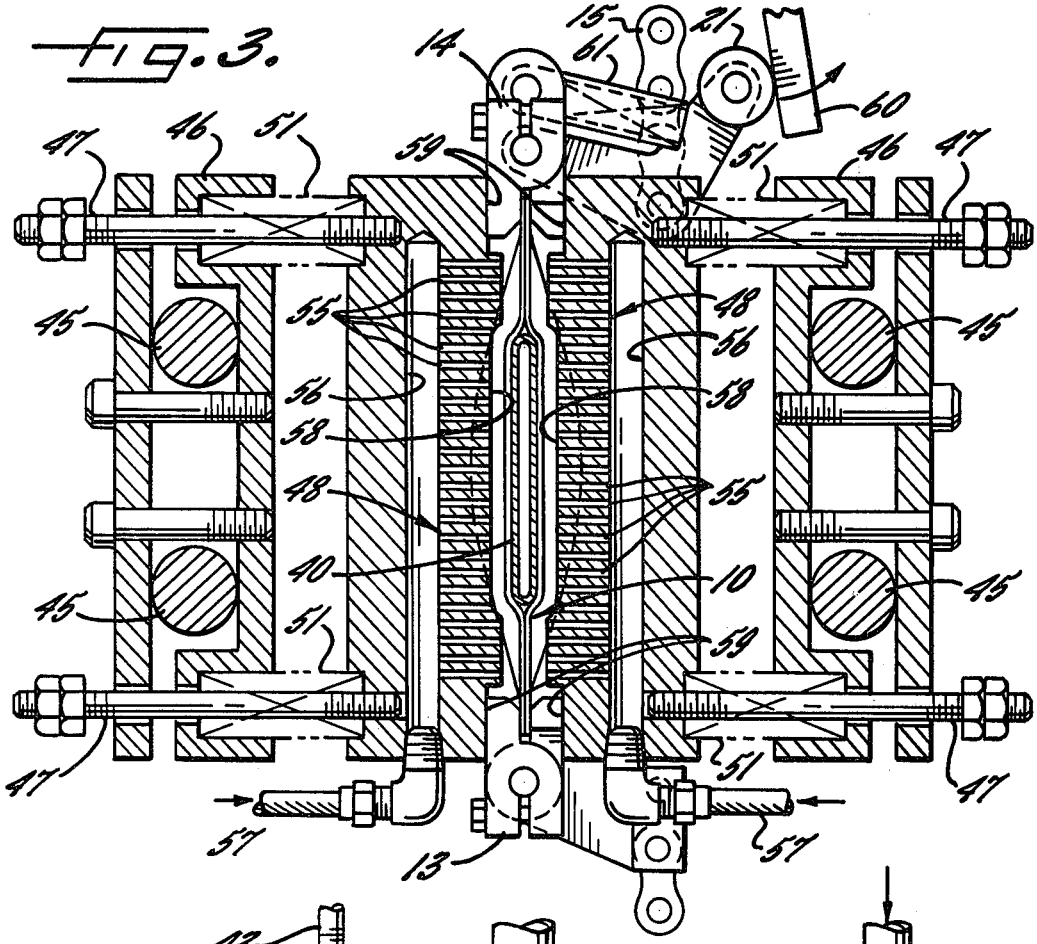
FIG. 3 is a view similar to FIG. 2 but shows certain parts in moved positions.
Figure 5:
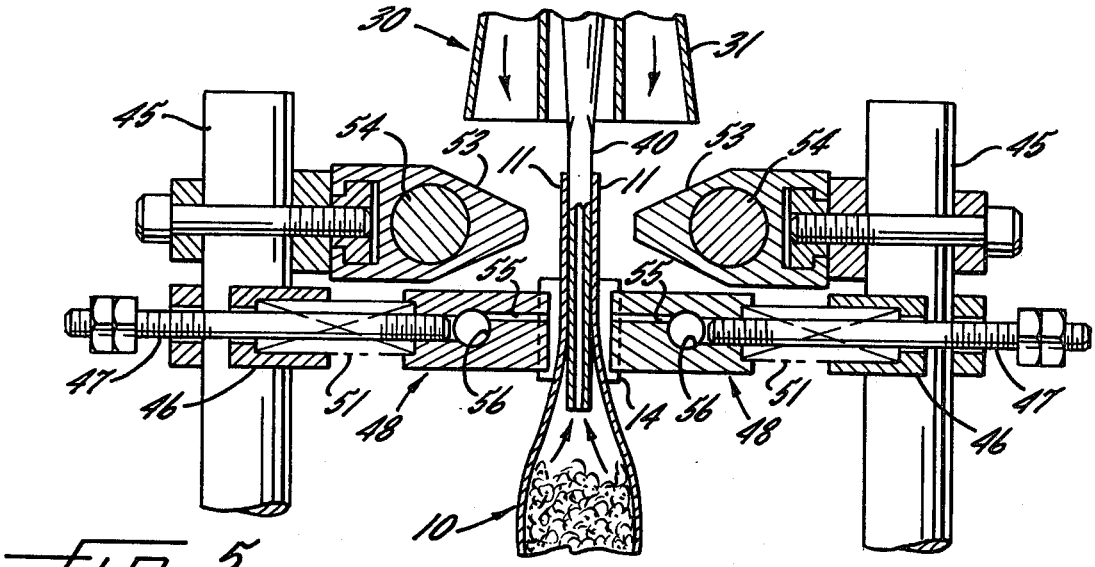
FIGS. 5, 6 and 7 are views similar to FIG. 4 but show subsequent steps which are followed in closing, evacuating and sealing the pouch.

At about the same time the clamp 14 is shifted away from the clamp 13, the rods 45 are shifted inwardly to cause the closing heads 48 to move inwardly toward the pouch 10 to active positions shown in FIGS. 3 and 5. The heads move inwardly until their notched end portions 59 engage and are positively stopped by the clamps 13 and 14. After the heads are stopped by the clamps, any slight additional inward movement of the rods 45 is accommodated by the mounting bars 46 sliding inwardly relative to the bolts 47 and by the springs 51 compressing (compare FIGS. 2 and 3). Once the heads have stopped, inward movement of the rods 45 is stopped momentarily to leave the sealing bars 53 spaced away from the pouch.

When the heads 48 stop, the inner ends of the passages 55 in the notches 58 are spaced outwardly from but are positioned closely adjacent that portion of the pouch 10 which receives the vacuum nozzle 40 while the remaining passages 55 are spaced outwardly from but are positioned closely adjacent the side edge portions of the pouch. Pressurized air is admitted into the heads via the lines 57 and the bores 56 and thus pressurized air jets are directed through the passages 55 and against the side panels 11 of the pouch. As a result, the upper ends of the center portions of the side panels 11 are pressed tightly around the vacuum nozzle while the upper ends of the side edge portions of the panels are pressed against one another (see FIGS. 2 and 5). The air jets cause the pouch to conform intimately to the nozzle and cause a good temporary seal to be established at the top of the pouch. Since the heads 48 do not physically contact the pouch, no wrinkles are formed in the pouch by the heads.

Figure 6:
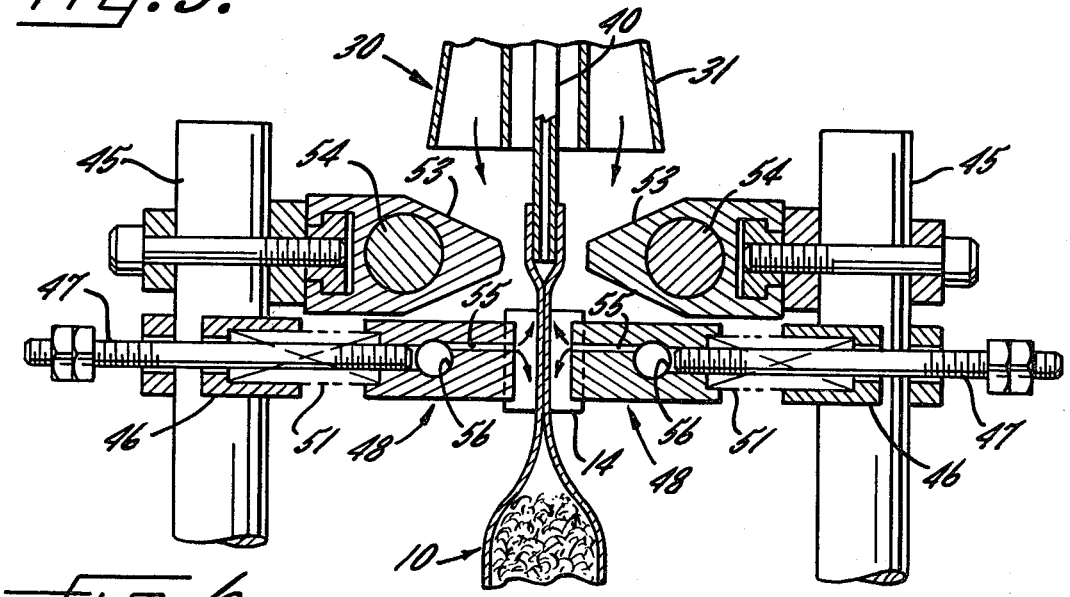

With the pouch 10 sealed along its top and around the nozzle 40 by the air jets, a vacuum is drawn through the nozzle 40 by the pump 42. Thus, the air in the pouch is evacuated through the vacuum nozzle. After a predetermined time period, the vacuum nozzle is retracted upwardly out of the pouch and upwardly within the steam nozzle 31 (see FIG. 6). As the lower end of the vacuum nozzle 40 clears the passages 55, the air jets close the center portions of the side panels 11 together along the top of the pouch as shown in FIG. 6. In addition, the spring 61 shifts the trailing clamp 14 rearwardly a short additional distance as soon as the lower end of the nozzle 40 clears the upper end of the pouch. Thus, the clamp draws the pouch taut and coacts with the air jets to hold the pouch closed.

Figure 7:
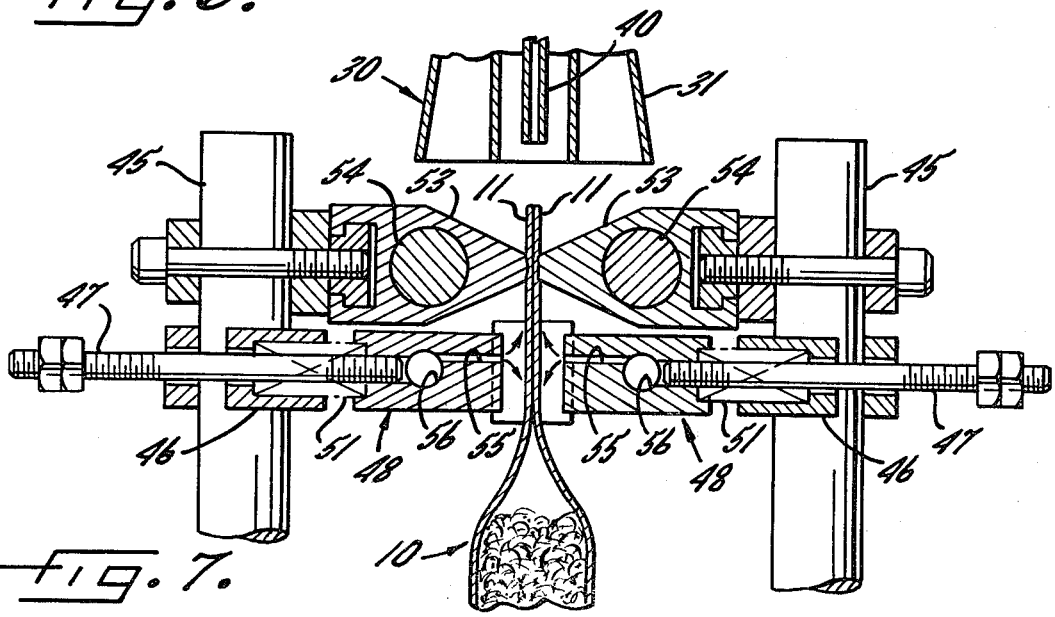

In the preferred embodiment of the invention, the rods 45 shift inwardly to bring the sealing bars 53 into engagement with the pouch and seal the upper end thereof immediately after the vacuum nozzle has been retracted from the pouch (FIG. 7). The springs 51 behind the heads 48 compress and the mounting bars 46 slide relative to the bolts 47 to allow the bars 53 to move inwardly relative to the heads during the sealing operation. A substantially wrinkle-free seal is formed as a result of the heads having previously closed the pouch without physcially touching the pouch.

After the seal has been formed, the rods 45 are retracted and the pouch 10 then is advanced out of the steaming station 30 and is shifted into a final sealing station 70 (FIG. 1) before being transferred to the discharge station 33 and the autoclave. When the pouch dwells at the station 70, a top seal of good quality is formed by a conventional impulse sealer comprising a sealing bar 71 and a backing bar 72, both bars being carried on rods 73 similar to the rods 45.

From the foregoing, it will be apparent that the present invention brings to the art new and improved heads 48 which close the pouch 10 tightly around the nozzle 40 without forming wrinkles in the top portion of the pouch. The heads find particular advantage where the pouch is subjected to steam since the steam tends to soften and wilt the pouch and makes the pouch more susceptible to wrinkling. The heads can, however, be used with machines where no steam is present and where a vacuum nozzle simply is inserted into the pouch to evacuate air therefrom. Also, the heads can be used in conjunction with a nozzle which introduces a non-oxidizing gas into the pouch to purge the pouch of oxygen.

While the pouches 10 have been specifically shown as being heat sealed in the steaming station 30, the initial heat sealing can take place in a downwtream station. Since the clamps 13 and 14 hold the pouch closed after retraction of the vacuum nozzle 40, the pouch can be advanced out of the steaming station and to a downstream station (e.g., the station 70) for initial heat sealing without danger of any substantial air entering the pouch.

I claim:

1. A packaging machine for filling, purging and sealing flexible pouches having open upper end portions, said machine comprising means for advancing the pouches open end up along a predetermined path, means for introducing product into each pouch, a nozzle, means for inserting said nozzle downwardly into each filled pouch, closing means operable to close the upper end portion of the pouch around said nozzle, means for creating a flow of gas through said nozzle to purge the pouch, means for retracting said nozzle out of the pouch, said closing means holding the upper end portion of the pouch closed around said nozzle as the nozzle is retracted, and means for sealing the upper end portion of the pouch after retraction of the nozzle, said machine being characterized in that said closing means comprise a pair of heads disposed on opposite sides of the upper end portion of the pouch, and means for directing pressurized gas through said heads and against the pouch whereby said pressurized gas closes the pouch around said nozzle and holds the pouch closed during retraction of the nozzle.

2. A packaging machine as defined in claim 1 further including means mounting said heads to move from inactive positions spaced away from the pouch to active positions located adjacent the pouch, said heads being located out of contact with the pouch when said heads are in said active positions.

3. A packaging machine as defined in claim 2 further including means for engaging said heads and stopping said heads in said active positions so as to prevent said heads from moving beyond said active positions and toward said pouch.

4. A packaging machine as defined in claim 3 in which said last-mentioned means comprise clamp means for holding the pouch and supported to move along said path, said clamp means engaging said heads when said heads are in said active positions.

5. A packaging machine as defined in any of claims 1 to 4 in which each of said heads comprises a manifold having a series of gas passages formed therethrough and spaced along said path.

6. A packaging machine as defined in claim 5 in which each manifold includes an inboard side facing said pouch, and a recess formed in the inboard side of each manifold between the upstream and downstream ends thereof, the shape of said recess being complementary to the shape of said nozzle.

7. A packaging machine for filling, evacuating and sealing pouches having open upper end portions and each defined by two face-to-face flexible side panels, said machine comprising mechanism for intermittently advancing the pouches open end up along a predetermined path through spaced filling and steaming stations with each pouch dwelling first in said filling station and then in said steaming station, a dispenser in said filling station for introducing product into each pouch while the latter dwells in said filling station, a steam nozzle located in said steaming station and above said path, means for introducing steam through said nozzle and into each pouch while the latter initially dwells in said steaming station and beneath said nozzle and for directing steam toward the pouch during the remainder of the dwell period, means for keeping the panels of each pouch spread away from one another to hold the upper end portion of the pouch in a widely open position while the pouch initially dwells beneath said nozzle thereby to enable the introduction of said steam into said pouch, a vacuum nozzle, means for inserting said vacuum nozzle downwardly into said pouch as the latter dwells beneath said steam nozzle and while the upper end portion of the pouch is held in a widely open position, closing means for thereafter closing the upper end portion of the pouch around said vacuum nozzle, means for drawing a vacuum through said vacuum nozzle to evacuate the air in the pouch, means for retracting said vacuum nozzle out of said pouch, said closing means holding the upper end portion of the pouch closed during and after retraction of said vacuum nozzle, and means in said steaming station for sealing the upper end portion of the pouch immediately after retraction of said vacuum nozzle and before the pouch is advanced from beneath said steam nozzle thereby to prevent the introduction of air into the pouch, said machine being characterized in that said closing means comprise a pair of heads disposed on opposite sides of the upper end portion of the pouch and located out of contact with the pouch, and means for directing jets of pressurized gas through said heads and against the side panels of the pouch whereby said gas jets close the side panels around said vacuum nozzle and hold the side panels closed after insertion of the vacuum nozzle, during and after retraction of the vacuum nozzle and during sealing of the pouch.

8. A method of filling, purging and closing flexible pouches having open upper end portions, said method comprising the steps of advancing the pouches open end up along a predetermined path, introducing product into each pouch while holding the upper end portion of the pouch in an open position, inserting a nozzle downwardly into each filled pouch, directing pressurized gas towards opposed sides of the pouch to close the upper end portion of the pouch around the nozzle, creating a flow of gas through the nozzle to purge the pouch, retracting the nozzle upwardly from the pouch while directing pressurized gas toward the sides of the pouch to hold the upper end portion of the pouch around the nozzle during retraction of the nozzle and closing the upper end portion of the pouch immediately after retraction of the nozzle.

* * * * *